US005361447A

United States Patent [19]

Ophardt

[11] Patent Number: 5,361,447

[45] Date of Patent: Nov. 8, 1994

[54] FREE STANDING MOP

[75] Inventor: Heiner Ophardt, Vineland, Canada

[73] Assignee: Hygiene-Technik Inc., Beamsville, Canada

[21] Appl. No.: 51,187

[22] Filed: Apr. 22, 1993

[30] Foreign Application Priority Data

Jan. 22, 1993 [CA] Canada ..... 2087929

[51] Int. Cl.[5] ..... A47L 13/252; B25G 3/38

[52] U.S. Cl. ..... 15/229.6; 15/144.1; 15/147.2

[58] Field of Search ..... 15/144.1, 144.2, 147.1, 15/147.2, 229.5, 229.6, 229.7, 229.8, 229.9; 403/92, 94, 96; 16/110 R, 111 R; 81/177.8, 177.7

[56] References Cited

U.S. PATENT DOCUMENTS

| | | | |
|---|---|---|---|
| 161,105 | 1/1873 | Craig . | |
| 697,682 | 4/1902 | Smith . | |
| 714,089 | 11/1902 | Wurm | 15/144.1 |
| 1,080,711 | 12/1913 | McHenry . | |
| 1,142,837 | 6/1915 | Nahr . | |
| 1,159,252 | 11/1915 | Nahr . | |
| 1,437,789 | 12/1922 | Whyte . | |
| 2,325,598 | 3/1942 | Fatland . | |
| 2,509,687 | 5/1950 | Lee | 15/144.1 |
| 2,740,146 | 4/1956 | Vaughn | 15/144.1 |
| 2,884,655 | 5/1959 | Maddox | 15/144.2 |
| 3,085,271 | 4/1963 | Janssen | 15/229.8 |
| 3,123,946 | 3/1964 | Hoveland | 15/144.2 |
| 3,132,834 | 5/1964 | Adams | 15/143.1 |
| 3,433,510 | 3/1969 | Hulterstrum | 15/144.2 |
| 3,533,122 | 10/1970 | Hesener | 15/147.1 |
| 3,720,974 | 3/1973 | Rosendall . | |
| 3,800,351 | 4/1974 | Fukuba . | |
| 4,170,803 | 10/1979 | Saito | 15/144.1 |
| 4,658,461 | 4/1987 | Roe et al. . | |
| 4,783,873 | 11/1988 | Young | 15/229.6 |

FOREIGN PATENT DOCUMENTS

| | | | |
|---|---|---|---|
| 21790 | 5/1930 | Australia | 15/144.2 |
| 587855 | 12/1959 | Canada | 15/144.2 |
| 950320 | 10/1956 | Germany | 15/144.1 |
| 161459 | 5/1920 | United Kingdom | 15/229.6 |
| 285667 | 2/1928 | United Kingdom | 403/92 |
| 332123 | 7/1930 | United Kingdom | 15/229.6 |

*Primary Examiner*—David A. Scherbel
*Assistant Examiner*—Tony G. Soohoo
*Attorney, Agent, or Firm*—Riches, McKenzie & Herbert

[57] ABSTRACT

This invention relates to a free standing implement such as a mop comprising: an elongate handle having a longitudinal axis; a base having a planar bottom adapted to support the mop with the handle in a free standing upright position; universal coupling means joining the base and handle; a nib having a rounded inward end extending inwardly from the handle beyond the universal coupling toward the base; and socket means, connected to the base and resiliently biased to engage the nib, for providing lateral resistance to brace the handle in said upright position and for releasing the handle to coact with the base in a universal manner when said axis is positioned at an acute angle relative to the planar bottom.

13 Claims, 5 Drawing Sheets

FREE STANDING MOP

FIELD OF THE INVENTION

The invention relates to a free standing handle, for an implement having a base and handle joined with a universal coupling, wherein the handle is resiliently retained in a free standing position when not in use.

BACKGROUND OF THE INVENTION

The design focus of mops, brooms, manual tools and other such implements often involves the joining of an elongate handle to a base. Accomodation of various movements of the handle relative to the base, and the capability to releasably position or lock the handle may be desirable to optimize the utility of the implement.

The flexible joining of a mop head to a handle, for example, is conventionally provided by use of a universal couple. A dust mop generally is constructed with an elongate handle, and a planar base interconnected with a universal joint to enable the positioning of the handle at any selected angle as the base is wiped across a floor surface.

The flexibility of a universal couple is advantageously used in such applications being able to accommodate rapid changes in relative orientation between joined members without discernible resistance, as well as being durable and easily manufactured.

Ironicly, the flexibility of a universal couple is also the primary disadvantage of its use in such implements. A conventional mop is not self supporting when not in use. Generally the mop handle is placed leaning against a wall or against furniture for support, with the flat base resting upon the adjacent floor.

A mop handle generally has a smooth even polished finish since it is repeatedly manually handled. As a result, the smooth handle often falls over by sliding down the wall or along the edge of furniture upon which it leans for support. The base may also slide along the floor under the weight of the leaning handle. The universal joint, smooth handle and smooth wall or furniture surface offer little resistance to sliding. Therefore, the mop user is forced to find a corner within which the handle may be securely supported. Laying the handle down upon the floor is often impractical, and forces the user to repeatedly stoop over to recommence use of the mop.

The process of delicately balance a leaning mop handle, moving away from the work area to find a supporting corner, picking up a fallen handle, and risking damage to adjacent furnishings from a falling handle, is an aggravating problem for commercial and household users which has spawned a number of ingenious solutions.

Unfortunately conventional solutions often merely introduce further problems due to their complexity. Household mops and other such household implements are low cost items which do not justify the expense of complex mechanisms, and may be discarded if broken since repair is impractical or spare parts unavailable. The response of the purchaser to breakage or increased expense would likely be to purchase a competing product.

Heavy duty commercial or industrial mops may justify a higher initial cost, however the more complex a joint mechanism is, the more likely it is to require maintenance. Such commercial mops must be rugged and withstand heavy abusive handling. Complex joint mechanisms which attract dirt deposits, require increased maintenance, and add cost are not practical or cost effective.

As a result, the simple universal coupling remains an industry standard despite its disadvantages. Conventional solutions, to the falling mop handle dilemma, have not proven to be any better on balance.

An example of a conventional dust mop is described in U.S. Pat. No. 2,325,598 to Fatland a handle is pivoted on a horizontal pin to a dust mop base via an inverted spring loaded cap. The cap can rotate in a ferrule in the center of the base to lock into radial notches in the ferrule. As a result the handle may be rotated about the ferrule between fixed positions. The handle may be raised and lowered between an upright position and an acute working angle by rotating about the horizontal pivoting pin. The pin is disengaged from the ferrule notches, against the biasing action of the cap spring, by the provision of a cam at the bottom end of the dust mop handle. The joint between the handle and base therefore can not be considered a true universal coupling, since in order to rotate the mop handle about a vertical axis, it is necessary first to disengage the pivot pin from locking engagement with the notches of the ferrule. As well the cam surface of the handle's inner end, combined with the biasing force of the cap spring, introduces an instability in the positioning of the handle tending to rotate it downwardly about the pivot pin. This instability is more pronounced if even a minor eccentricity in the location of the pivot pin on the handle is introduced in manufacturing. As a result balancing the dust mop handle in a stable upright position is difficult if not impossible.

A single pivot pin attaches a handle to a floor sweeper device in the U.S. Pat. No. 3,720,974 to Rosendale. The pivot pin allows the handle to rotate about a single horizontal axis on ears upwardly projecting from the body of the floor sweeper. Slots are cut in the floor sweeper body between the ears which interact with the cam shaped lower end of the handle. As a result the handle is spring loaded to enhance its stability in an upright position.

Another example of a conventional household implement is described in U.S. Pat. No. 3,533,122 to Hesener relating to a handle for a handmop used for cleaning household crockery. The handle and a base are joined with a pin to rotate about a single axis transverse to the longitudinal axis of the handle. A cam surface of the base interacts with the open mouth of an inverted U shaped spring to lock the handle in various relative angular orientations.

From the above described examples of conventional implements it appears heretofore considered necessary to either forego the advantages of a universal coupling or to introduce unacceptable complexity in the design and manufacturing of otherwise very simple implements.

It is therefore desirable to provide a simply constructed and easily maintained free standing implement such as a mop with an elongate handle and a base adapted to support the mop with the handle in a free standing upright position.

SUMMARY OF THE INVENTION

The invention overcomes the disadvantages of the prior art in a novel manner by providing an implement, such as a mop, which has an elongate handle and a base joined with a universal coupling. The base is adapted to support the mop with the handle in a free standing upright position through the interaction of a rounded nib at the bottom end of the handle and a spring loaded tab attached to the base. The tab includes a socket to engage the nib thereby providing sufficient lateral resistance to brace the handle in an upright position and releasing the handle and base to coact universally when the handle is at an acute angle to the base.

Therefore a free standing mop according to the invention is very simply manufactured with a conventional universal couple, without the addition of complex mechanisms to achieve the considerable advantage of a stable free standing configuration.

Accordingly the invention provides a free standing implement such as a mop comprising: an elongate handle having a longitudinal axis; a base having a planar bottom adapted to support the mop with the handle in a free standing upright position; universal coupling means joining the base and handle; a nib having a rounded inward end extending inwardly from the handle beyond the universal coupling toward the base; and socket means, connected to the base and resiliently biased to engage the nib in said upright position, for providing lateral resistance to brace the handle in said upright position and for releasing the handle to coact with the base in a universal manner when said axis is positioned at an acute angle relative to the planar bottom.

Further aspects of the invention will become apparent upon review of the following detailed description.

BRIEF DESCRIPTION OF THE DRAWINGS

In order that the invention may be readily understood, a preferred embodiment of the invention will be described by way of example with reference to the accompanying drawings in which.

DETAILED DESCRIPTION OF PREFERRED EMBODIMENTS OF THE INVENTION

Figure 2:
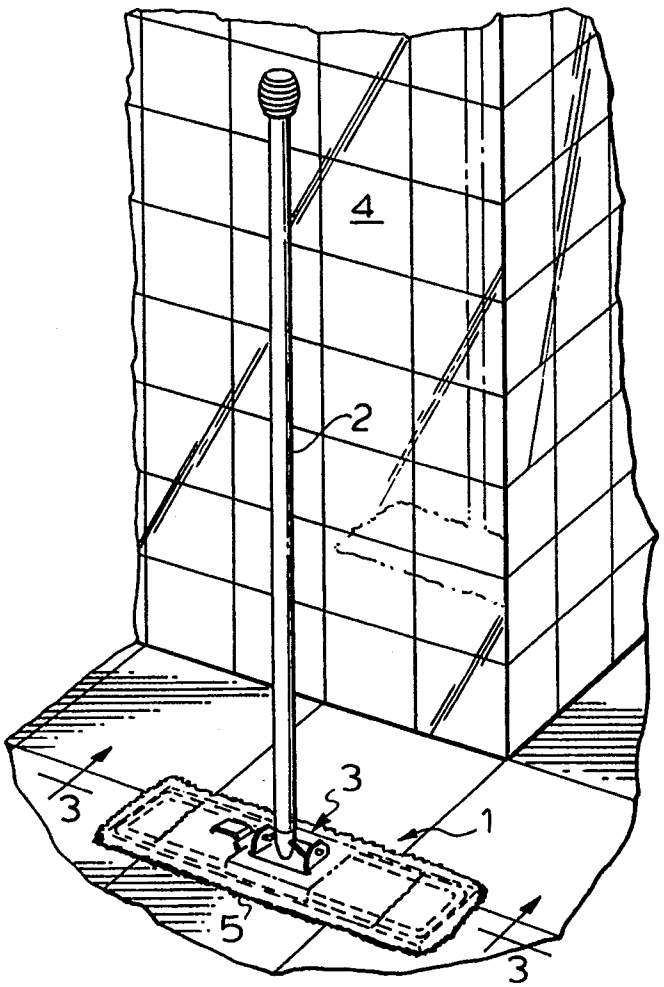
FIG. 2 is a view similar to FIG. 1, showing a mop according to the invention with the handle in a free standing upright position.
Figure 1:
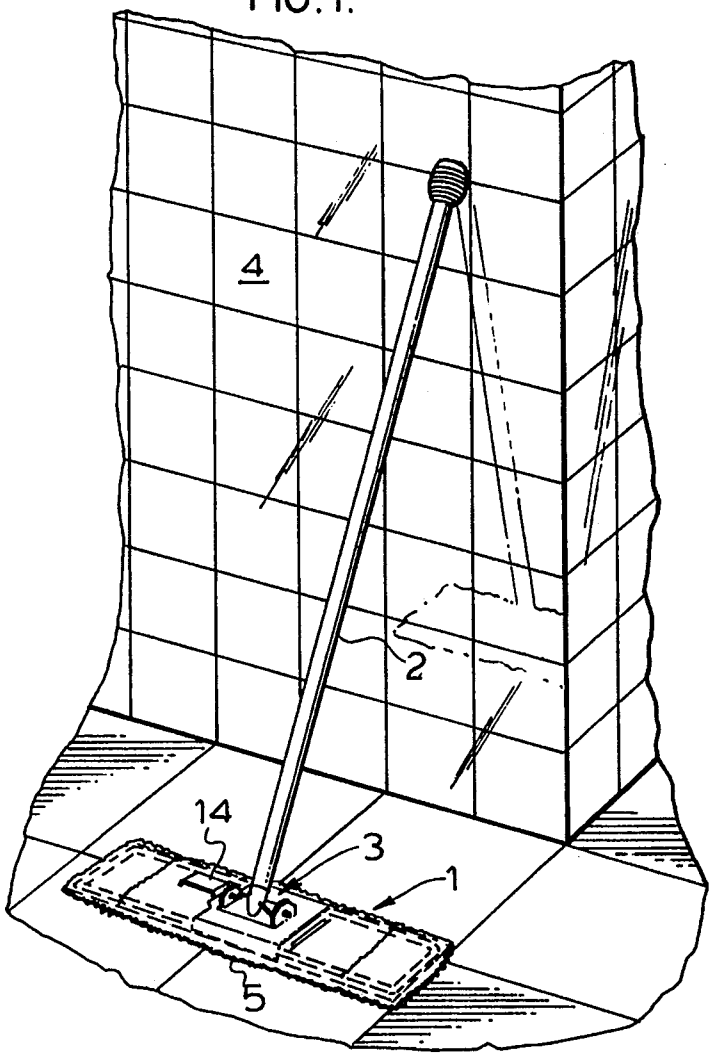
FIG. 1 is a perspective view of a conventional mop having a base and handle joined with a universal coupling, with the handle leaning against an adjacent wall for support.

The primary advantage of the invention is clearly shown by comparing the mops of FIGS. 1 and 2. FIG. 1 shows a conventional mop with a base 1 and handle 2 joined with a universal coupling 3. Frequently the operator sets aside the mop to perform other cleaning functions or to rest. A conventional mop, as shown in FIG. 1, must be positioned with its handle 2 leaning against a wall 4 or adjacent furniture for support due to the flexibility of the universal joint 3. The disadvantages of such mops have been described above in detail.

The mop shown in FIG. 2, may also be positioned leaning against the wall 4, however to greater advantage, according to the invention, the mop may be balanced on the planar bottom of its base 1, with the handle 2 in a free standing upright position. Means are included which provide a degree of lateral resistance high enough to brace the handle 2 in the upright position shown. The degree of resistance is low enough to also maintain the flexibility of the universal coupling 3, thereby allowing the handle 2 to coact with the base 1 in a universal manner when the handle 2 is positioned at an acute operating angle relative to the base 1 in use.

Therefore the degree of resistance to movement of the handle 2 is of importance in ensuring that conventional free floating universal action is maintained while providing enough resistance to ensure that the upright configuration (FIG. 2) is stable and reliable.

It will be understood that although the preferred embodiment is illustrated and described as applied to a mop, the invention may be applied to various other implements to equal advantage.

Figure 3:
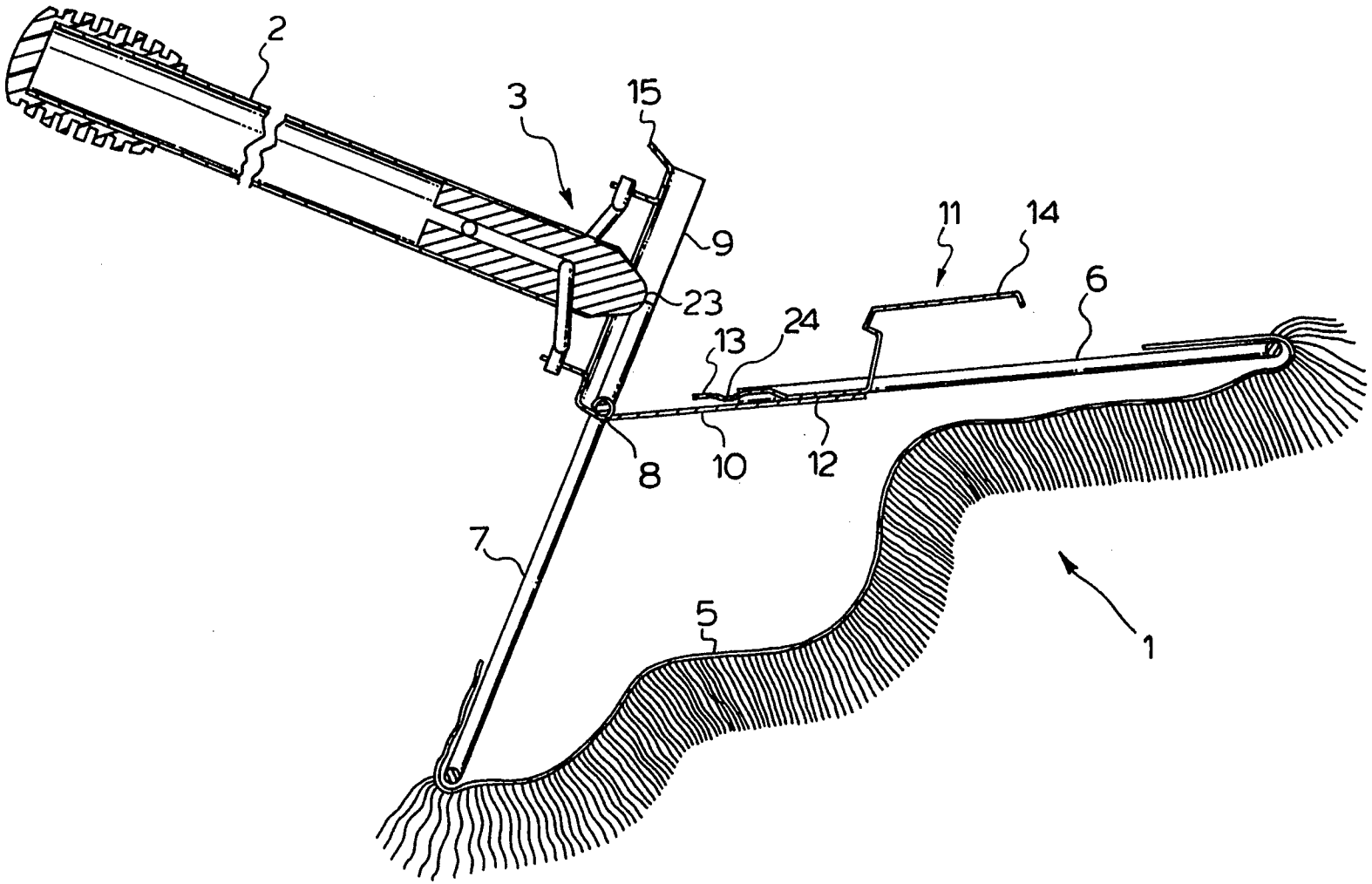
FIG. 3 is a sectional view of the mop, along the longitudinal axis of the base identified as line 3—3 of FIG. 2, with the hinged base in an open position to enable removal of the cloth mop cover.
Figure 4:
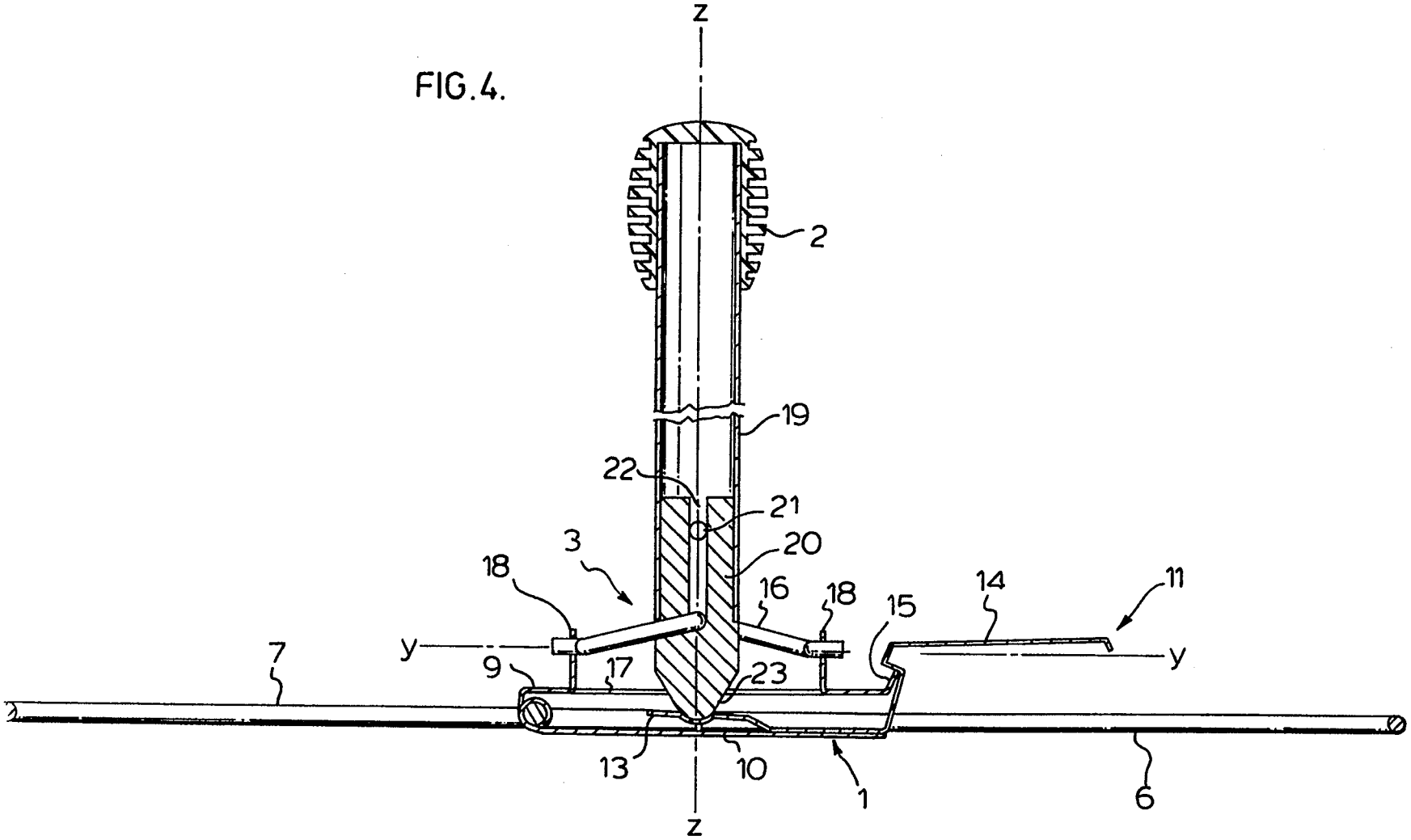
FIG. 4 is a sectional view like FIG. 3 with the hinged base in closed position and the cloth mop cover removed.

As shown in FIG. 3, the base 1 is releasably hinged to facilitate the removal of a fabric mop head cover 5. A first base member 6, and a second base member 7 are joined with a hinge 8 to rotate between open and closed positions (FIGS. 3 and 4 respectively). The inward overlapping top and bottom plates 9 and 10, of the base members 7 and 6, are stamped from sheet metal. U-shaped metal rods are welded to the inward portions to construct a hollow lightweight base 1.

Figure 7:
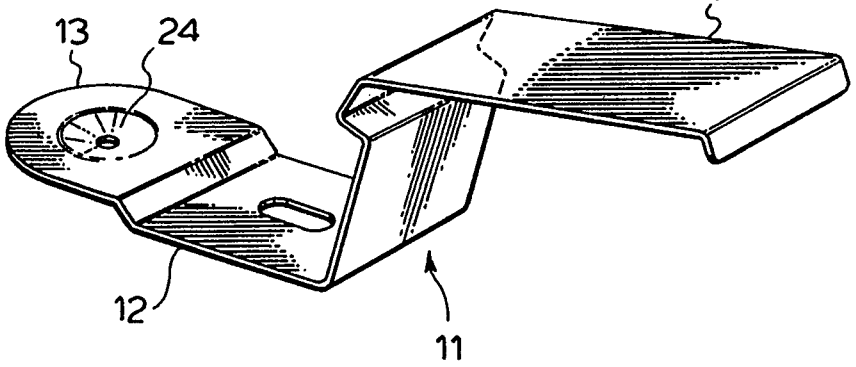
FIG. 7 is an isometric view of the clip forming a combined tab and latching mechanism.
Figure 6:
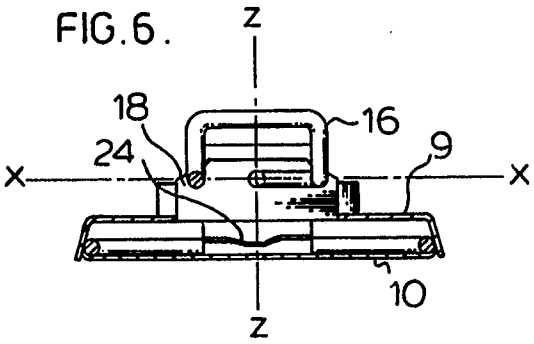
FIG. 6 is a sectional elevation view of the base along line 6—6 of FIG. 5.

A resilient clip 11 performs dual functions to secure the base 1 in a closed position and to brace the handle 2. FIG. 3 shows the clip 11 in its assembled position, whereas FIG. 7 illustrates the clip 11 in isolation to reveal its detailed structure. A strip of resilient material such as spring steel may be bent to simply manufacture the clip 11. A centre portion 12 of the clip 11 is fixed, by rivets for example, to the bottom plate 10 at an edge of an overlapping base zone opposite the hinge 8. An inward portion of the clip 11 forms a resilient tab 13. An outward portion of the clip 11 forms a resilient latch and release member 14 to retain the lip 15 of the top plate 9 in a closed position during use.

Figure 5:
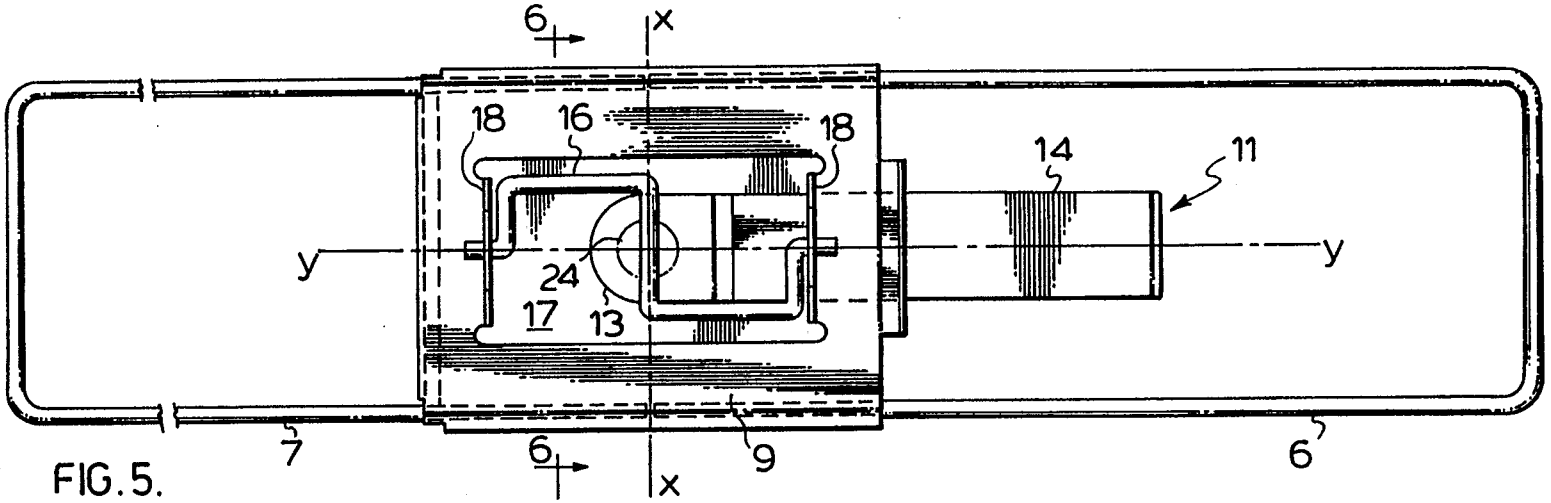
FIG. 5 is a top plan view of the mop base with handle removed to clearly illustrate the S-shaped universal joint pin, as well as the combined resilient socketed tab and base latching mechanism.

The universal coupling 3 joining the handle 2 and base 1 is most clearly illustrated in elevation view FIG. 4 and plan view FIG. 5. The top plate 9 has a central opening 17 bounded on two sides by upturned ears 18. A generally S-shaped pin 16 is journalled at its two ends in bores drilled in the ears 18 and pivotally supports the handle 2 in its central portion. As a result, the handle 2 may rotate about a first transverse axis x—x on the central portion of the pin 16, and may rotate about a second transverse axis y—y on the ends of the pin 16 journalled in the ears 18. Universal coupling therefore is achieved in a simple manner using a single pin 16.

In the embodiment illustrated axis x—x and axis y—y are vertically offset however both axes may also be made coplanar if desirable using a flat S-shaped pin 16 (not shown).

The elongate handle 2 has a longitudinal axis z—z which passes through the centre of the tab 13 when the base 1 is closed and the handle 2 is in an upright position. As illustrated in FIG. 4 the handle 2 may be constructed of a light weight hollow tube 19 with a solid end piece 20 secured to the tube 19 with a screw 21. The solid end piece 20 accomodates the concentrated stresses from the pin 16. The pin 16 extends through an aligned notch in the end of the tube 19 and a slot 22 in the end piece 20. The slot 22 and notch simplify assembly of the universal coupling and enable the handle 2 and base 1 to be easily separated for shipping.

The solid end piece 20 includes a nib 23 having a rounded inward end. The nib 23 extends inwardly from the handle 2 beyond the universal coupling 3 toward the base 1. A mating frusto-spherical socket 24 in tab 13 is resiliently biased to engage the nib 23, the details of which are most clearly shown in FIG. 7.

With the base 1 in the closed position, shown in FIG. 4, the upward biasing of the tab 13 engaging the nib 23 provides sufficient lateral resistance to prevent the upright balanced handle 2 from rotating about the transverse axes x—x and y—y. The weight of the handle 2 is supported upon the central portion of the S-shaped pin 16 and therefore the upward biasing force of the tab 13 may be accurately tuned to provide precisely the degree of lateral resistance necessary to brace the handle 2 in the upright position. The biasing force of the tab 13 is also low enough to avoid interferring with the free floating operation of the universal coupling 3.

Figure 8:
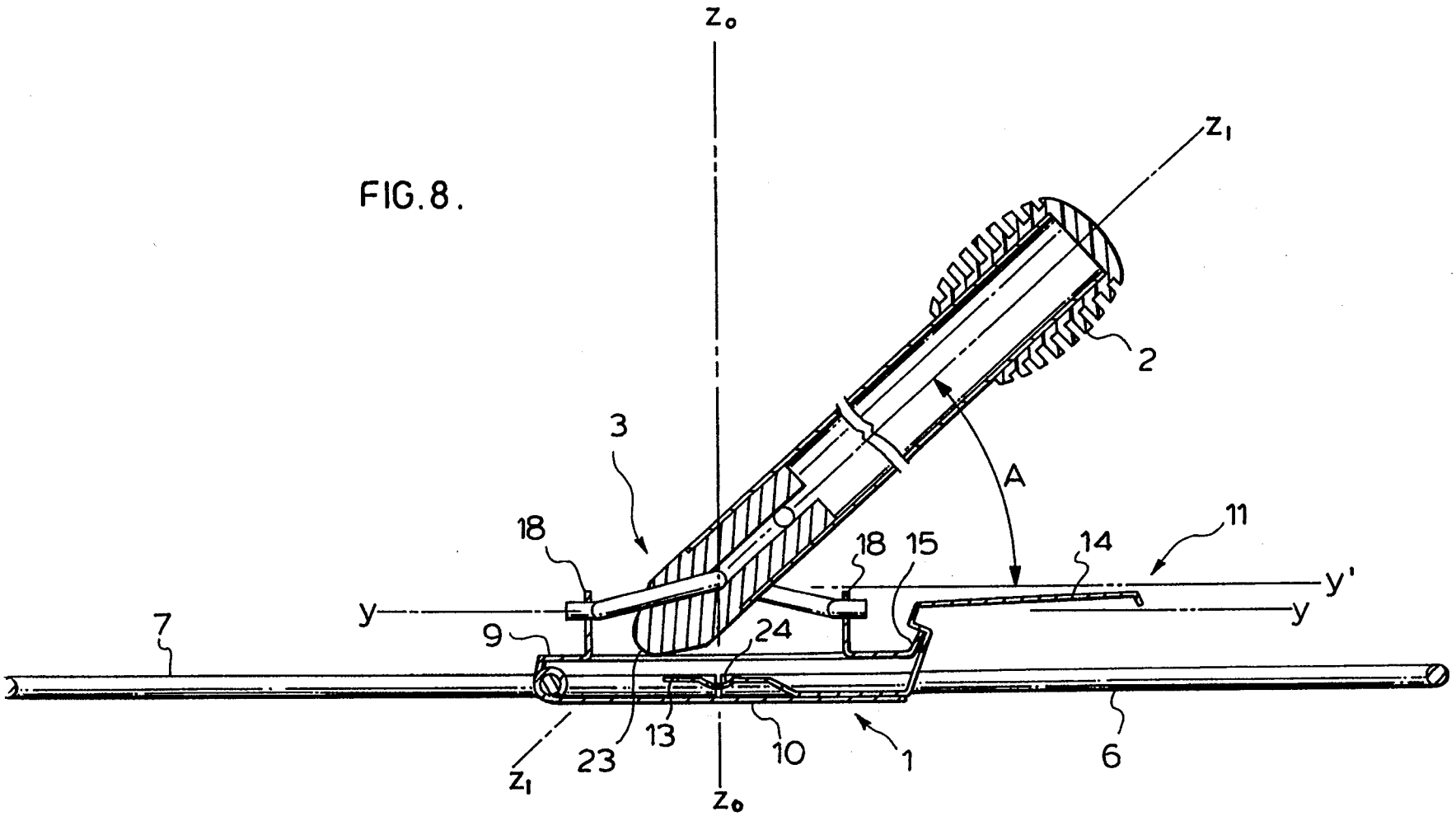
FIG. 8 is a view like FIG. 4 with the mop handle at an angle "A" to the base in its operating position showing the tab and nib disengaged.

FIG. 8 shows the handle 2 positioned at an acute operating angle "A". Preferrably the rounded nib 23 remains in contact with the tab 13 only in the upright position (FIG. 4). When the mop is in use the nib 23 is rotated out of contact with the tab 13 due to the acute operating angle A at which the mop handle 2 is generally used. However the relative movement of the nib 23 and tab 13, as the handle 2 is rotated about axes x—x and y—y between the upright and operating positions, does not result in unacceptable frictional resistance since the nib 23, tab 13 and mating socket 24 are all smoothly rounded and polished.

Preferrably the range of angle "A" at which the handle 2 is braced in an upright position is relatively narrow, for example approximately 85°-90°. At an intermediate range of angle "A" for example 80°-85°, the nib 23 will contact the tab 13 peripherally outward of the socket 24. Accordingly the socket 24 is relatively shallow. A shallow socket 24 ensures smooth transition between upright and operating positions and also is adequate to retain the nib 23 if the resilient tab 13 is relatively stiff.

As clearly shown in FIG. 8, when the mop handle 2 is rotated from an upright position to an operating position, the nib 23 and tab 13 disengage. As a result, the universal joint 3 functions in a conventional manner free of any resistance. The resilient tab 13 of course will rebound upward a slight amount however disengagement of the tab 13 and nib 23 is preferrably complete during use of the mop. Although not shown in the drawings it will be understood that rotation of the handle 2 about axis x—x alone also results in complete disengagement of the tab 13 and nib 23. It is possible to construct a tab 13 which would remain in engagement with the nib 23 during operation however the increased resistance to movement of the handle 2 and wearing of the nib 23 are disadvantageous.

In the preferred embodiment, the nib 23 is engaged within the socket 24 when the handle is in the upright position, that is when angle A is about 90°. As the handle is moved from the upright position the nib 23 comes to disengage from within the socket 24. Preferrably the nib 23 is disengaged from the socket 24 when angle A is less than about 87.5°, more preferrably less 85°, 80°, or than 75°. After the nib 23 becomes disengaged from socket 24, the nib 23 may still be engaged with portions of tab 13 surrounding the socket. Preferrably the nib 23 is disengaged from contact with any portion of tab 13 when the angle A is less than about 87.5°, more preferrably less than about 85°, 80°, 75°, or 60°.

The actual optimal value of angle A of the handle when in actual use depends upon the length of the handle, height of user, and other factors however a practical range for angle A is 0° to 70° and preferrably 0° to 60° or 15° to 45° for most mops or like implements.

The socket 24 and nib 23 therefore coact to form a self-centering detent which locates and braces the handle 2 in an upright free standing position upon the supporting planar bottom of the base 1. The tab 13 allows the handle 2 to coact with the base 1 in a universal manner when the handle axis z—z is positioned at an acute angle A relative to the planar bottom of the base 1.

The precise degree of biasing force required to perform the functions of the tab 13 is dependent upon the material properties of the clip 11, the bent shape of the tab 13, the profile of the nib 23 and socket 24, the weight and shape of the handle 2 and other factors. As a result, the biasing force is determined by trial and error for a specified mop design. In use the operator may marginally adjust the biasing force to suit their personal preference by bending the tab 13 up or down a slight degree as desired.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

I claim:

1. A free standing implement comprising:

an elongate handle having a longitudinal axis;

a base having means for supporting the implement with the handle in a free standing upright position, said means for supporting comprising a planar bottom;

a universal joint coupling, joining the base and handle;

a nib extending longitudinally from the end of said handle beyond the universal joint coupling toward the base;

socket means connected to the base; and means for resiliently biasing the socket means to engage the nib when said handle is in said upright position whereby said engagement provides lateral resistance to brace the handle in said upright position and said socket means releases said nib so that said handle may coact with the base in a universal manner when said axis is positioned at an acute angle relative to the planar bottom.

2. An implement as claimed in claim 1 wherein said socket means disengages said nib when said angle is less than about 80°.

3. An implement as claimed in claim 1 wherein said socket means disengages said nib when said angle is less than about 60°.

4. An implement according to claim 1 wherein the socket means comprise a resilient tab having a first portion fixed to the base and a free second portion resiliently biased toward the nib, the second portion of the tab having a nib mating socket.

5. An implement according to claim 4 wherein the base includes a removable fabric cover.

6. An implement according to claim 5 wherein the cover is a mop head.

7. A free standing mop comprising: an elongate handle having a longitudinal axis;

a base having means for supporting the implement with the handle in a free standing upright position, said means for supporting comprising a planar bottom, the longitudinal axis of the handle intersecting said planar base at an inwardmost point of the implement, the handle and base extending outwardly from said point, the base being releasably hinged to facilitate removal of a mop head cover, the base comprising:

a first base member; a second base member an inward portion of which overlaps an inward portion of the first base member, thus defining an overlapping zone; and a hinge joining the base members at one edge of said overlapping zone, the base members being rotatable between open and closed positions; universal joint coupling means, joining the base and handle;

a nib having a rounded inward end extending inwardly from the handle beyond the universal joint coupling toward the base; and a resilient clip having:

a first central portion fixed to the first base member at an opposite edge of said overlapping zone;

an inward portion of the clip comprising resilient tab means resiliently biased for engagement with the nib in said upright position and having a socket adapted to mate the nib; and an outward portion of the clip comprising resilient latch and release means for resiliently retaining the second base member in a closed position, the tab means for providing lateral resistance sufficient to brace the handle in said upright position and for releasing the handle to coact with the base in a universal manner when the handle axis is positioned at an acute angle relative to the planar bottom.

8. A mop according to claim 7 wherein said socket disengages said nib when said angle is less than about 80°.

9. A mop according to claim 8 wherein said socket disengages said nib when said angle is less than about 60°.

10. A mop according to claim 7, wherein said resilient clip comprises a bent strip of resilient material.

11. A mop according to claim 10, wherein said base is made of steel, and said strip is made of spring steel.

12. A mop according to claim 7, wherein said socket is frusto-spherical shaped.

13. A mop as claimed in claim 7 wherein said tab has planar land portions surrounding said socket, the socket disengaging said nib when said angle is less than about 85°, and said nib being free from any engagement with the tab when said angle is less than about 80°.

* * * * *